US008469214B2

(12) United States Patent
Boukobza

(10) Patent No.: US 8,469,214 B2
(45) Date of Patent: Jun. 25, 2013

(54) CONTAINER, IN PARTICULAR A BOTTLE, MADE OF A THERMOPLASTIC MATERIAL, PROVIDED WITH A REINFORCED BASE

(75) Inventor: Michel Boukobza, Octeville-sur-Mer (FR)

(73) Assignee: Sidel Participations, Octeville sur Mer (FR)

( * ) Notice: Subject to any disclaimer, the term of this patent is extended or adjusted under 35 U.S.C. 154(b) by 768 days.

(21) Appl. No.: 12/482,908

(22) Filed: Jun. 11, 2009

(65) Prior Publication Data

US 2009/0308835 A1 Dec. 17, 2009

(30) Foreign Application Priority Data

Jun. 13, 2008 (FR) ..... 08 53921

(51) Int. Cl.
*B65D 1/02* (2006.01)
*B65D 1/46* (2006.01)

(52) U.S. Cl.
USPC ..... 215/375; 215/272; 220/608

(58) Field of Classification Search
USPC ..... 215/373, 375, 377; 220/606, 608, 220/609
See application file for complete search history.

(56) References Cited

U.S. PATENT DOCUMENTS

| | | | | |
|---|---|---|---|---|
| 3,403,804 | A * | 10/1968 | Colombo | 215/45 |
| 4,355,728 | A * | 10/1982 | Ota et al. | 215/375 |
| 4,785,950 | A * | 11/1988 | Miller et al. | 215/375 |
| 4,892,205 | A * | 1/1990 | Powers et al. | 215/375 |
| 5,071,015 | A * | 12/1991 | Kinslow | 215/375 |
| 5,713,480 | A * | 2/1998 | Petre et al. | 215/373 |
| 5,906,286 | A * | 5/1999 | Matsuno et al. | 215/375 |
| 6,276,546 | B1 * | 8/2001 | Davis et al. | 215/375 |
| 2001/0001200 | A1 * | 5/2001 | Zhang | 215/375 |
| 2002/0153343 | A1 * | 10/2002 | Tobias et al. | 215/375 |
| 2004/0173565 | A1 * | 9/2004 | Semersky et al. | 215/382 |
| 2004/0211746 | A1 * | 10/2004 | Trude | 215/374 |
| 2005/0199578 | A1 * | 9/2005 | Young et al. | 215/375 |
| 2008/0035601 | A1 | 2/2008 | Derrien | |

FOREIGN PATENT DOCUMENTS

| | | |
|---|---|---|
| EP | 1 645 515 A1 | 4/2006 |
| WO | 2006/067590 A1 | 6/2006 |
| WO | 2008/017746 A2 | 2/2008 |

OTHER PUBLICATIONS

French Preliminary Search Report for FR 08 53921.

* cited by examiner

*Primary Examiner* — Sue A Weaver
(74) *Attorney, Agent, or Firm* — Sughrue Mion, PLLC

(57) ABSTRACT

Thermoplastic container having a body and a base including: a concave arch, a concave dome opening at the center of the arch, an annular zone surrounding the base of the arch and forming a flat foundation, claw-shaped zones radially extending the base of the body and offset projecting outwards relative to the arch, and radial grooves delimited between the zones in the shape of claws. The grooves have bottoms that are formed by radial sections of the arch and that have a radially variable depth maximum in correspondence with said annular zone forming a foundation. The base is adapted for withstanding, without marked deformation, hydrostatic pressure due to the liquid column increased by an excess pressure not exceeding approximately 2×105 Pa.

10 Claims, 4 Drawing Sheets

CONTAINER, IN PARTICULAR A BOTTLE, MADE OF A THERMOPLASTIC MATERIAL, PROVIDED WITH A REINFORCED BASE

FIELD OF THE INVENTION

The present invention relates to improvements made to containers, in particular bottles, made of a thermoplastic material such as PET, having a body extending between, at the top, a neck and, at the bottom, a base adapted for withstanding without marked deformation the hydrostatic pressure due to the liquid column increased by an excess pressure not exceeding approximately $2\times10^5$ Pa, said base comprising:

- a concave arch having a concavity turned towards the outside of the container,
- a dome projecting towards the inside of the container and having a concavity turned outwards, opening at the centre of said arch,
- an annular zone surrounding the lower part of said arch and forming a substantially flat foundation by which said base can stably rest on a flat support, and
- ribs shaped as grooves opening outwards, extending substantially radially across said annular zone forming a foundation and rising into the wall connecting with the wall of the body.

BACKGROUND OF THE INVENTION

Containers intended to contain a still liquid (for example bottles intended to contain drink water) are, in the majority of cases, provided with a rounded base in the general form of a spherical cap having a concavity turned outwards and of relatively small height. Such bases are often provided with substantially radially radiating ribs which are distributed around a central recess, said ribs possibly having various shapes and optionally extending possibly onto the lower part of the wall of the body in order to reinforce the foundation (peripheral zone with which the base rests on a support). The height of bases of this type, including the central reinforcement, is typically of the order of 10 mm, and can be up to 15 mm.

Such bases are suitable for withstanding, without deformation, the column of still liquid which rises above them. However, they do not offer sufficient resistance to withstand an additional stress, even though small, that may be due for example to an internal excess pressure.

Now, it is known, during the packaging of certain readily oxidizable still liquids (for example oil, fruit juices), to pour a small liquid quantity (for example one drop) of an inert substance that evaporates quickly (for example generally nitrogen) onto the surface of the still liquid at the end of the phase of filling the container in order to remove the air (and therefore the oxygen contained therein) from the free volume rising above the liquid surface immediately before the sealing of the container (an operation known as "inertization" or "nitrogenation") or to improve the pressurization of the container in the case of weakly carbonated liquids. This small quantity of inert substance ceases to evaporate once the sealing has finished, such that inertization gas remains in the sealed container under a small residual pressure below $2\times10^5$ Pa, typically of the order of $1\times10^5$ Pa, even of the order of $0.5\times10^5$ Pa.

The weakly rounded bases traditionally provided for containers intended for still liquids cannot reliably withstand, without deformation, even a pressure as small as that generated by the inertization process.

It is also known, for containers whose contents must undergo an inertization process, to provide them with bases that are improved in terms of resistance such that they do not deform under the action of the internal excess pressure.

A reinforced base of this type which is normally used at the present time is illustrated in FIGS. 1A to 1D of the attached drawings. FIG. 1A is a side view of the lower part of a container 1' (here a bottle having the general shape of a substantially cylindrical body of revolution) made of a thermoplastic material such as PET, having a body 2' extending between, at the top, a neck (not shown) and, at the bottom, a base 3'. The base 3' is represented, alone, in FIG. 1B in a bottom view, in FIG. 1C in diametral section along the line IC-IC of FIG. 1B, and in FIG. 1D in perspective from below.

The base 3' comprises an arch 4' having a rounded general shape with a concavity turned towards the outside of the container 1' and it has an annular zone 5' surrounding the arch 4' and forming a substantially flat foundation with which said base 3' can stably rest on a flat support. In the central part thereof, the arch 4' opens onto a rounded dome 6' which also has a concavity turned outwards, said dome being therefore situated offset towards the inside of the container relative to the arch. Outside the annular zone 5' forming a foundation, the base 3' has a wall 8', turned inward, also called connecting wall 8' for connection with the wall 9' of the body 2' of the container.

Several main ribs 7' opening outwards, having the general shape of troughs with substantially parallel edges and having a substantially constant depth, extend radially in a star pattern from the inward-turned wall 8' of the base 3' to the dome 6' in which they end, while crossing the annular zone 5' forming a foundation and the arch 4'; in the example illustrated, there is an odd number of main ribs 7', here equal to five. To improve the mechanical resistance of the base, secondary ribs 10' are added, which can have substantially the same structure as the main ribs 7', which are interspersed between the main ribs 7', but extend radially in a star pattern from the inward-turned wall 8' of the base 3' only as far as the middle of the arch 4', while crossing the annular zone 5' forming a foundation.

It will be emphasized that all the ribs, both the main ribs 7' and the secondary ribs 10', are formed sunken in the arch 4', which has a smooth annular shape notched only by the ribs, as is clear from FIGS. 1A to 1D.

Manufacturers of containers made of a thermoplastic material such as PET constantly seek to make the containers lighter, which is reflected in, among other things, a lightening of the bases of the containers. For this reason, bases of containers having shapes which were satisfactory a few years ago are no longer suitable, because of the perceptible reduction in the quantity of material used.

Thus experience showed that a reinforced base designed as described above was no longer satisfactory, in a lightened version thereof, even for excess pressures of only approximately $1\times10^5$ Pa.

Now, the distribution of the drops of inertization liquid requires, in order to be precise, dosing equipment which is relatively costly and which manufacturers avoid using. In these conditions, the drops of inertization liquid are formed in a more or less empirical manner and the volume thereof can vary very substantially, in practice between half and double the desirable theoretical value. As a result, the excess pressure generated inside the container can be much higher than the desired value of approximately $1\times10^5$ Pa and can reach up to $2\times10^5$ Pa. The aforementioned bases, in their lightened version, cannot thus reliably withstand such an excess pressure without yielding.

From document FR 2 883 550, a container provided with a reinforced base which was intended for the same application is admittedly known. However, this also relates to a container intended to be manufactured with a substantial quantity of thermoplastic material and which does not make it possible to obtain the lightened version that manufacturers require today.

It is admittedly known, in the case of carbonated liquids (for example with a pressure of about 3 to $4\times10^5$ Pa, even up to $10\times10^5$ Pa), to design containers, the base of which has a much more pronounced curvature (called "champagne base" or similar) adapted for withstanding relatively high pressures without deformation. However, such bases require an increased quantity of thermoplastic material, both because of their greater height and because of the increased wall thickness, at least locally, in the annular zone forming a foundation. Containers provided with such bases therefore prove to be more costly and their correct shaping during moulding is more tricky. It is therefore not desirable to provide bases of this type to containers subjected to an inertization step, even less so as they are shaped to withstand much higher pressures than those created by the inertization operation: their high resistance and the extra cost which is associated with them appear excessive for the envisaged application.

SUMMARY OF THE INVENTION

It is in this context that the invention aims to propose an improved shape of a rounded base for containers to be filled with still liquids and sealed in the presence of a relatively small pressure in principle of the order of $1\times10^5$ Pa and in practice not exceeding approximately $2\times10^5$ Pa, requiring only a minimum of thermoplastic material, easy to shape correctly in customary conditions for blow moulding or stretch-blow moulding of containers intended for still liquids, and having a height substantially of the same order as that of the bases of traditional containers for still liquids.

To these ends, a container, in particular a bottle, made of a thermoplastic material such as PET and arranged as mentioned in the preamble is characterized in that said base comprises:

- zones separated from each other and being claw-shaped, which extend the bottom of the body radially in the direction of the centre of the base and which are offset projecting outwards relative to said arch, and
- radial grooves delimited between said claw-shaped zones, said grooves having bottoms formed by said arch and having a radially variable depth which is maximum approximately in correspondence with said annular zone forming a foundation.

Due to such an arrangement, a base is provided in which the reinforcing structure constituted by the claw-shaped zones stands out against the arch and, occupying a major part of the surface of the arch, stiffens the latter much more effectively than the ribs of the current bases were able to do.

Preferably, it is provided that the radial ends of said claw-shaped zones are distant from the edge of said dome, such that a complete annular zone of the arch remains around the dome. The resultant structure thus has three levels, namely the central dome which is the deepest level (seen from outside), the arch which surrounds the dome and extends like a star to form the bottoms of the grooves and which is an intermediate level, and finally the claw-shaped zones which form an outermost upper level.

This structure allows great freedom of practical realization. Thus, the dome can be rounded. The arch can also be rounded, for example in a spherical zone, or also be shaped as the frustrum of a cone.

In practice, it can advantageously be provided that said annular zone forming a foundation has a diameter which is comprised between approximately 70% and 90% of the diameter of the body, and that said arch has a height which is comprised between approximately 10% and 25% of the diameter of the annular zone forming a foundation.

It can also be beneficial that the base has a height which is approximately 15% of the diameter of the annular zone forming a foundation.

Similarly, it can also be beneficial that the height of the dome is comprised between approximately 10% and 50% of the height of the arch.

Thus, thanks to the provisions according to the invention, it is possible to provide a container made of a thermoplastic material such as PET, which is adapted for withstanding, without deformation, inertization pressures that can on occasion reach approximately $2\times10^5$ Pa, while still being made from a smaller quantity of material. By way of example, a 1.5 L PET container arranged according to the invention can be manufactured with a weight of thermoplastic material of the order of 22 gr, while only three years ago the weight of standard PET containers of equivalent volume and according to document FR 2 883 550 mentioned above was of the order of 26 to 27 gr (i.e. a reduction of approximately 15% in the weight of PET used per container).

BRIEF DESCRIPTION OF THE DRAWINGS

The invention will be better understood on reading the following detailed description of certain embodiments given solely by way of example that are in no way limitative. In this description, reference is made to the attached drawings in which.

DETAILED DESCRIPTION OF THE INVENTION

Figure 1A:
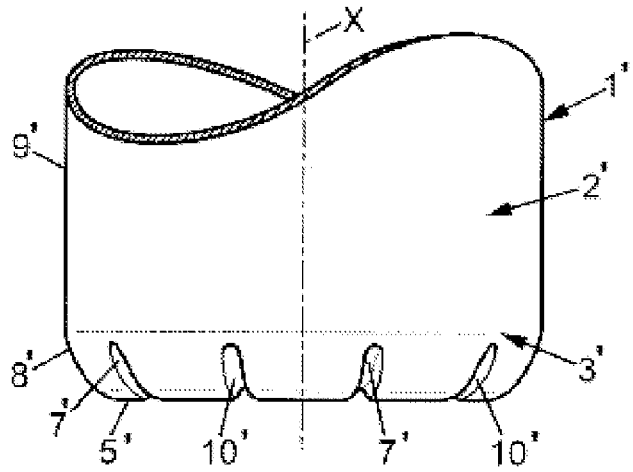
FIG. 1A (RELATED ART)
FIG. 1A is a side view of the lower part of a container (here a bottle having the general shape of a substantially cylindrical body of revolution) made of a thermoplastic material such as PET designed according to the state of the art.
Figure 1B:
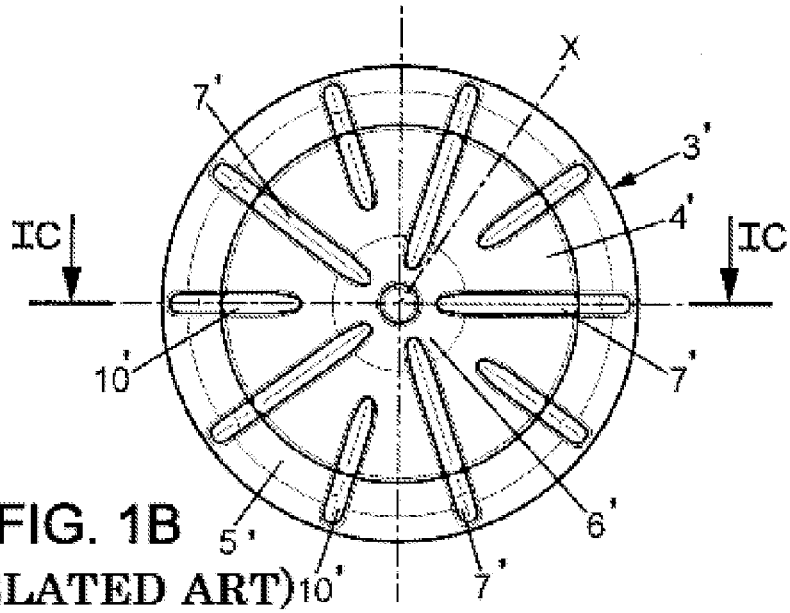
FIG. 1B (RELATED ART)
FIGS. 1B to 1D are views, respectively seen from below, in diametral section along the line IC-IC of FIG. 1B, and in perspective from below, of only the base of the container shown in FIG. 1A.
Figure 1C:
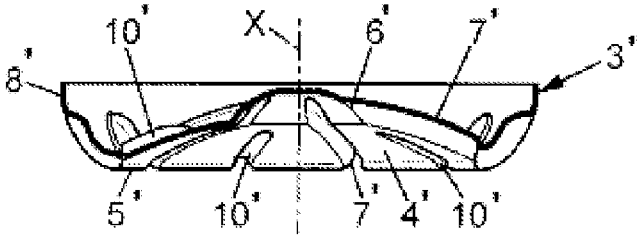
FIG. 1C (RELATED ART)
Figure 1D:
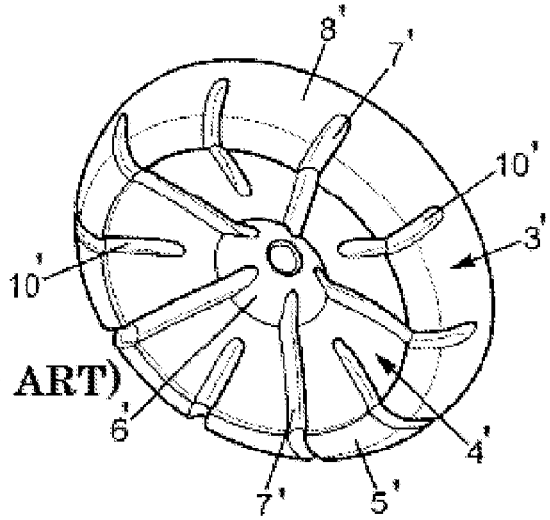
FIG. 1D (RELATED ART)

In the following description, the related reference numbers as were used previously in reference to FIGS. 1A to 1D will be used to identify identical elements or parts.

Referring first of all to FIGS. 2A to 2D, the container 1, here a bottle having the general shape of a substantially cylindrical body of revolution, made of a thermoplastic material such as PET, has a base 3 which comprises:

- a concave arch 4 having a concavity turned towards the outside of the container,
- a dome 6 projecting towards the inside of the container and having a concavity turned outwards, opening at the centre of said arch 4,
- an annular zone 5 surrounding the base of said arch 4, close to but set back from the periphery of the base 3, and forming a substantially flat foundation due to which said base 3 can stably rest on a flat support, and ribs in the form of grooves opening outwards, extending substantially radially across said annular zone 5 forming a foundation and rising into the wall 8 connecting with the wall 9 of the body.

According to the invention, the base 3 comprises claw-shaped zones 11, separated from each other, which extend the bottom of the body radially in the direction of the centre of the base and which are offset projecting outwards relative to said arch 4. In other words, the claw-shaped zones 11 are like curvilinear plateaux rising above the level of the arch 4 while still following the radial shape of the latter, as can be seen better in FIG. 2B and especially in FIG. 2D.

The claw-shaped zones 11 delimit between them radial grooves 12, whose base 13 is formed by radial sections 4*a* of said arch 4. In other words, while the main ribs 7 of the current bases are embedded in the arch 4 as clearly shown in FIGS. 1A to 1D, the grooves 12 of the base arranged according to the invention are formed above the arch 4, raised relative to the latter.

Moreover, the grooves 12 have a depth which is variable in radial direction. The inversion of curvature, at 16, of the bottom 13 of the grooves 12 is situated approximately in correspondence with the annular zone 5 forming a foundation, as can be seen in FIG. 2C. It is at this point that the depth p of the grooves 12 is maximum, such that the reinforcement effect is maximum at the foundation, which ensures the maintenance of the shape, and therefore of the flatness thereof. The depth of the grooves 12 decreases progressively on either side until it becomes zero at the external and internal ends of the grooves, as is better seen in FIGS. 2A, 2C and 2D.

Figure 2A:
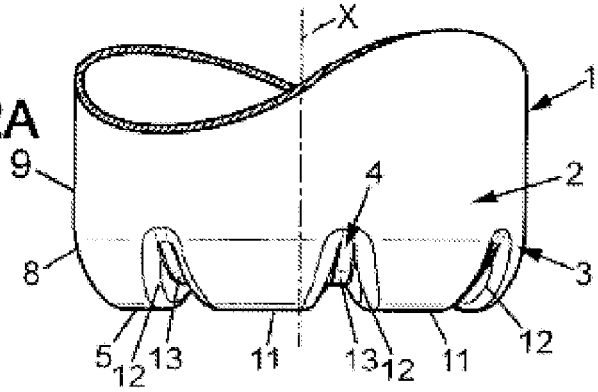
FIGS. 2A to 2D are views, respectively seen from the side, seen from below, in diametral section along the line IIC-IIC of FIG. 2B, and in perspective from below, of a base designed according to the invention.
Figure 2B:
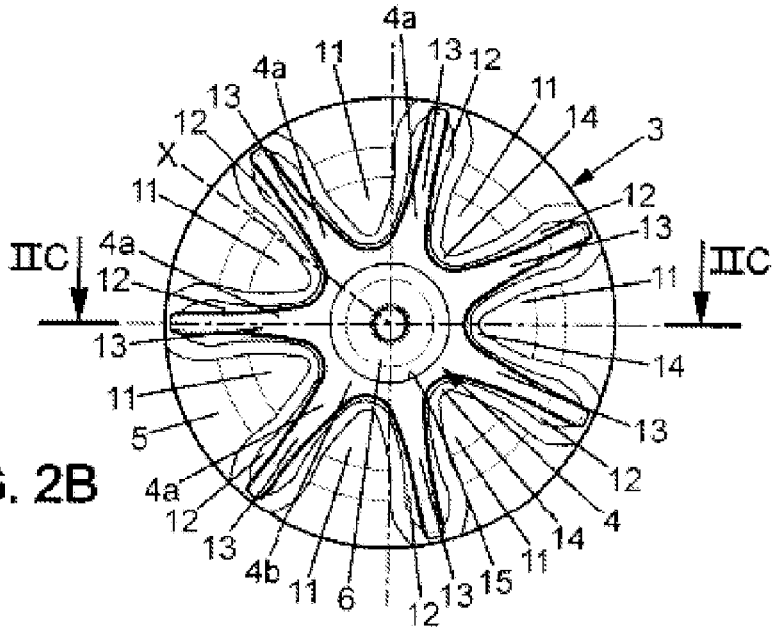
Figure 2C:
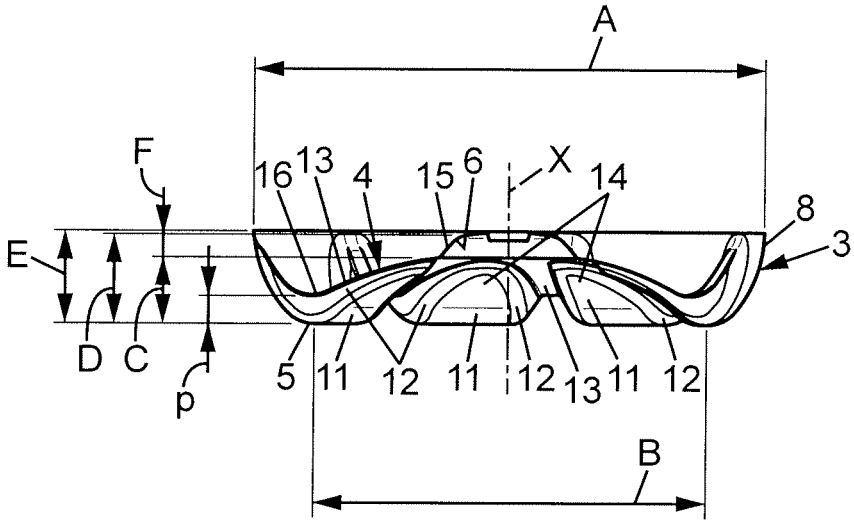
Figure 2D:
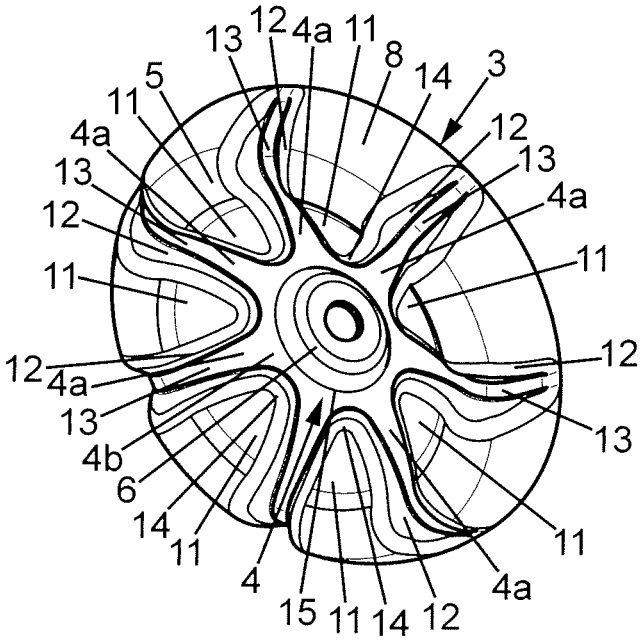

It will be noted that, in the example illustrated in FIGS. 2A to 2D, the radial ends 14, which are the closest to the central axis X of the base, of said claw-shaped zones 11 remain at a distance from the edge 15 of the dome 6 such that the dome 6 is surrounded by an annular fringe 4*b* of the arch 4 which connects to the said radial sections 4*a* forming the bottoms 13 of the grooves 12, the visible parts of the arch 4 thus having the appearance of a stellate structure with radiating branches as can be seen better in FIGS. 2B and 2D.

It will also be noted that, in the example illustrated in FIGS. 2A to 2D, the arch 4 is rounded, and is here more specifically rounded approximately in the shape of a spherical zone, although other rounded shapes can certainly be considered.

Regarding what is now the geometric shape of the base 3, it is advantageous (see FIG. 2C) that the annular zone 5 forming a foundation has a diameter B which is comprised between approximately 70% and 90% of the diameter A of the body 2 of the container 1, and that the arch 4 has a height C which is comprised between approximately 10% and 25% of the diameter B of the annular zone 5 forming a foundation.

Furthermore, it may be desirable that the base 3 has a height E which is approximately 15% of the diameter B of the annular zone 5 forming a foundation.

Equally, it may be desirable that the height F of the dome is comprised between approximately 10% and 50% of the height C of the arch, i.e. that the total height D of the structure formed by the dome 6 and the arch 4 (in other words cumulative heights F of the dome 6 and C of the arch 4) is comprised between 1.10% and 1.50% of the height C of the arch 4.

Finally, the geometry of the base 3 can advantageously conform to the following relationships:

$$0.70A<B<0.90A$$

$$0.10B<C<0.25B$$

$$1.10C<D<1.50C$$

$$0.15B<E$$

Thanks to the features which have just been described, a container 1 made of a thermoplastic material such as PET is provided being fitted with a base 3 which is arranged according to the invention and which, while still being constituted by a smaller quantity of thermoplastic material, is suitable to withstand the hydrostatic pressure due to the liquid column increased by a nominal excess pressure of approximately $1\times10^5$ Pa, that can in practice reach approximately $2\times10^5$ Pa, without said base experiencing marked deformation.

Of course, features which have just been described can give rise to numerous embodiment variants.

Figure 3A:
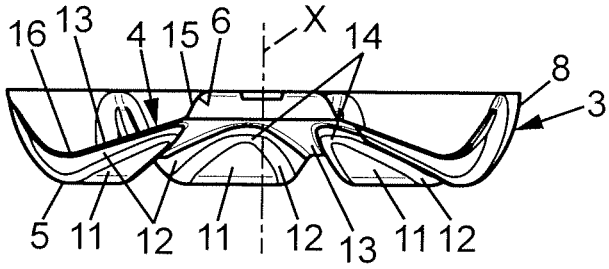
FIGS. 3A and 3B are views, respectively in diametral section and in perspective from below (corresponding respectively to views 2C and 2D above), of a variant embodiment of a base designed according to the invention.
Figure 3B:
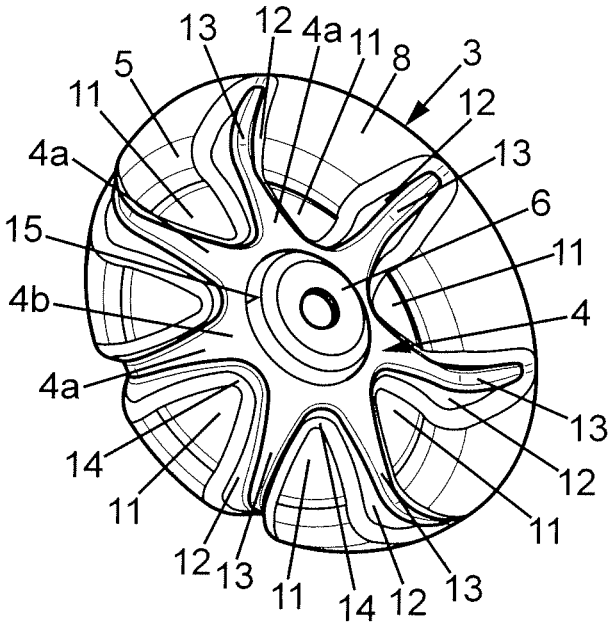

Thus, in the example described above and represented in FIGS. 2A and 2D, the arch 4 is rounded and the claw-shaped zones 11 constitute curvilinear plateaux. By way of a variant, in the embodiment of the base 3 illustrated in FIGS. 3A and 3B, the arch 4 is still concave having a concavity turned towards the outside of the container; however, this arch is no longer domed, but frustoconical surrounding the dome 6. Thus, as is seen better in FIG. 3A, the bottoms 13 of the grooves 12 are substantially flat and inclined while the zones 11 in the shape of claws constitute substantially flat and inclined plateaux. For the rest, the base 3 illustrated in FIGS. 3A and 3B remains identical to what was described above.

What is claimed is:

1. A container made of a thermoplastic material, having a body extending between, at the top, a neck and, at the bottom, a base, said base comprising:

a concave arch having a concavity turned towards the outside of the container, a dome projecting towards the inside of the container and having a concavity turned outwards, opening at the center of said arch, an annular zone surrounding the base of said arch and forming a substantially flat foundation on which said base can stably rest on a flat support, claw-shaped zones, separated from each other, which extend the bottom of the body radially in the direction of a central axis of the base and which are offset projecting outwards relative to said arch, and radial grooves delimited between said claw-shaped zones, said grooves having bottoms formed by radial sections of said arch, said grooves extending outwardly from said bottoms formed by radial sections of said arch towards said annular zone, and which have a radially variable depth which is maximum approximately in correspondence with said annular zone.

2. The container as claimed in claim 1, wherein radial ends of said claw-shaped zones are at a distance from the edge of said dome.

3. The container as claimed in claim 1, wherein the arch is rounded.

4. The container as claimed in claim 1, wherein the arch is a frustum of a cone.

5. The container as claimed in claim 1, wherein the dome is rounded.

6. The container as claimed in claim 1, wherein a diameter of said annular zone comprised between approximately 70% and 90% of a diameter of the body, and wherein said arch has a height which is comprised between approximately 10% and 25% of the diameter of the annular zone.

7. The container as claimed in claim 1, wherein the base has a height which is greater than approximately 15% of a diameter of the annular zone.

8. The container as claimed in claim 1, wherein a height of the dome is comprised between approximately 10% and 50% of a height of the arch.

9. The container as claimed in claim 1, wherein the base is adapted for withstanding without marked deformation hydrostatic pressure due to still liquid column increased by an excess pressure not exceeding approximately $2\times10^5$ Pa.

10. A container made of a thermoplastic material, having a body extending between, at the top, a neck and, at the bottom, a base, said base comprising:

a concave arch having a concavity turned towards the outside of the container, a dome projecting towards the inside of the container and having a concavity turned outwards, opening at the center of said arch, an annular zone surrounding the base of said arch and forming a substantially flat foundation on which said base can stably rest on a flat support, claw-shaped zones, separated from each other, which extend the bottom of the body radially in the direction of a central axis of the base and which are offset projecting outwards relative to said arch, and radial grooves delimited between said claw-shaped zones, said grooves having bottoms formed by radial sections of said arch and which have a radially variable depth which is maximum approximately in correspondence with said annular zone, wherein a transition from each claw-shaped zone to an adjacent radial groove is generally convex outwardly.

* * * * *